United States Patent [19]

Cunningham

[11] 4,165,272

[45] Aug. 21, 1979

[54] HOLLOW CATHODE FOR AN ELECTROLYTIC CELL

[75] Inventor: Hugh Cunningham, Corpus Christi, Tex.

[73] Assignee: PPG Industries, Inc., Pittsburgh, Pa.

[21] Appl. No.: 928,646

[22] Filed: Jul. 27, 1978

[51] Int. Cl.[2] ..... C25B 13/02; C25B 11/03; C25B 9/00

[52] U.S. Cl. ..... 204/282; 204/252; 204/253; 204/283

[58] Field of Search ..... 204/282, 283, 252, 253, 204/288-289

[56] References Cited

U.S. PATENT DOCUMENTS

| | | | |
|---|---|---|---|
| 1,117,185 | 11/1914 | Griffin | 204/282 X |
| 4,013,525 | 3/1977 | Emsley | 204/283 X |
| 4,073,715 | 2/1978 | De Nora et al. | 204/283 X |
| 4,115,237 | 9/1978 | Woodard et al. | 204/283 X |

FOREIGN PATENT DOCUMENTS

| | | | |
|---|---|---|---|
| 487666 | 1/1976 | U.S.S.R. | 204/252 |

*Primary Examiner*—John H. Mack
*Assistant Examiner*—D. R. Valentine
*Attorney, Agent, or Firm*—Richard M. Goldman

[57] ABSTRACT

Disclosed is an electrolytic cell cathode having a hollow cathode finger with fins extending outwardly therefrom. A synthetic separator surrounds the cathode and rests upon the fin-like extensions.

16 Claims, 6 Drawing Figures

FIG. 3
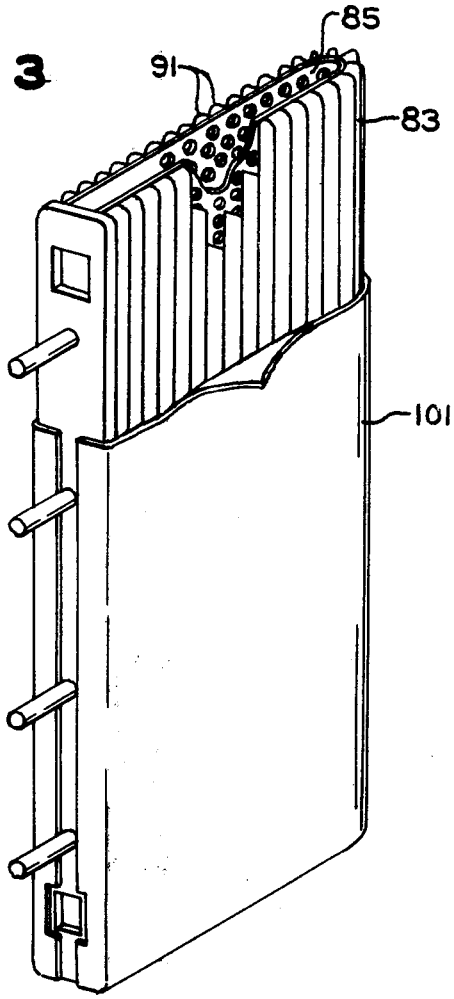
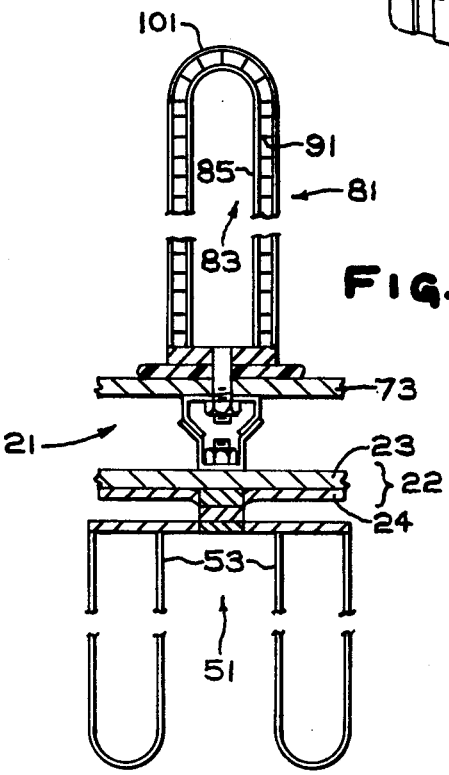
FIG. 4
FIG. 5
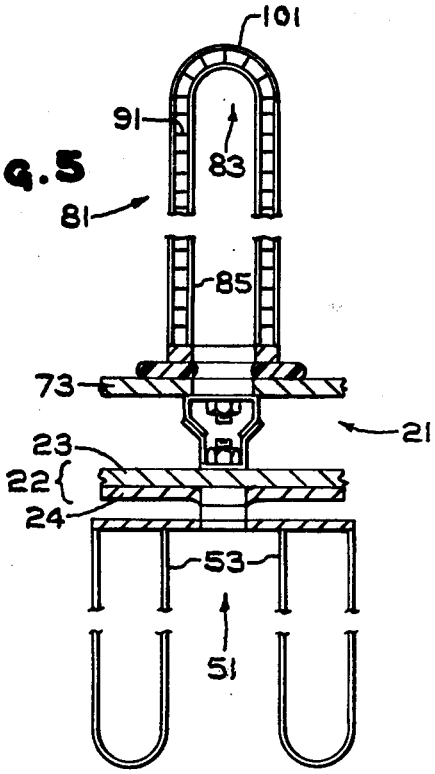

HOLLOW CATHODE FOR AN ELECTROLYTIC CELL

DESCRIPTION OF THE INVENTION

Electrolysis of alkali metal chlorides, for example, potassium chloride or sodium chloride brines, to produce chlorine and the corresponding alkali metal hydroxide, such as, caustic soda or caustic potash, may be carried out in an electrolytic cell having an anode separated from a cathode by a suitable separator. In such a cell, referred to as a diaphragm cell, e.g., an asbestos diaphragm cell or a synthetic microporous diaphragm cell, or a permionic membrane cell, the anolyte liquor, i.e., the electrolyte in contact with the anode, is acidified, chlorinated brine containing from about 175 to about 250 grams per liter of sodium chloride or from about 220 to about 320 grams per liter of potassium chloride at a pH of from about 1.5 to about 5.5.

The catholyte liquor, also referred to as the cell liquor, is a strongly alkaline solution of either potassium hydroxide or sodium hydroxide. In a permionic membrane cell, the catholyte liquor is substantially chloride-free in a permionic membrane cell and contains from about 10 to about 50 weight percent alkali metal hydroxide. In a diaphragm cell, the catholyte liquor contains from about 15 to about 25 weight percent sodium chloride or from about 19 to about 35 weight percent potassium chloride.

The separator between the anolyte and the catholyte may be an asbestos diaphragm, that is, a diaphragm prepared of fibrous and particulate asbestos deposited from a cell liquor slurry. Such a separator is electrolyte permeable and provides a catholyte liquor containing either from about 15 to about 25 weight percent sodium chloride and about 10 to about 15 weight percent sodium hydroxide or from about 19 to about 35 weight percent potassium chloride and from about 13 to about 20 weight percent potassium hydroxide.

Alternatively, the separator may be a synthetic separator as will be described more fully hereinafter. Synthetic separators may either be microporous diaphragms or permionic membranes. Microporous diaphragms are electrolyte permeable providing a catholyte liquor containing either from about 15 to about 25 weight percent sodium chloride and about 10 to about 15 weight percent sodium hydroxide or from about 19 to about 35 weight percent potassium chloride and from about 13 to about 20 weight percent potassium hydroxide.

Alternatively, the synthetic separator may be a permionic membrane having acid groups on the polymeric material. Such acid groups provide cation selectivity. That is, the permionic membrane is permeable to the flow of cations and impermeable to the flow of anions. In a permionic membrane cell, the catholyte is substantially chloride free, typically containing less than 1 weight percent alkali metal chloride and preferably less than about 0.1 weight percent alkali metal chloride, and from about 10 to 50 weight percent alkali metal chloride.

The synthetic separator itself is most commonly fabricated of a halogenated polymeric material, that is, a halocarbon polymer. Halocarbon polymers inlcude fluorocarbons, chlorofluorocarbons, hydrocarbon-fluorocarbons, and hydrocarbon-chlorofluorocarbons.

Fluorocarbon polymers include polymers having perfluoroethylene, hexafluoropropylene, and perfluoro alkyl vinyl ether moieties as well as copolymers and terpolymers thereof. Chlorofluorocarbons include polymers, copolymers, and terpolymers of chlorotrifluoroethylene with perfluoroethylene, hexafluoropropylene, and perfluoro alkyl vinyl ethers.

Hydrocarbon-fluorocarbon polymers include polymers of vinyl fluoride and of vinylidene fluoride, copolymers of ethylene with vinyl fluoride, vinylidene fluoride, tetrafluoroethylene, hexafluoropropylene, and perfluoro alkyl vinyl ethers, and copolymers of vinyl fluoride or vinylidene fluoride with each other or with perfluoroethylene, hexafluoropropylene, or perfluoro vinyl alkyl ether.

Hydrocarbon-chlorofluorocarbons include copolymers of vinyl fluoride, vinylidene fluoride, ethylene, vinyl chloride, and vinylidene chloride with chlorofluorocarbons as well as copolymers of vinyl chloride and vinylidene chloride with perfluoroethylene, hexafluoropropylene, and perfluoro alkyl vinyl ethers.

Polymers having a high degree of fluorination are particularly desirable for the service herein contemplated.

Where the synthetic separator is a microporous diaphragm, acid groups either may or may not be present in the polymer. However, where the synthetic separator is a permionic membrane, acid is present on the polymer to function as cation selective sites. Cation selective acid groups include sulfonyl groups, derivatives of sulfonyl groups such as sulfonamides, sulfonic acid groups, carboxylic acid groups, derivatives of carboxylic acid groups such as esters, phosphonic acid groups, and phosphoric acid groups. Most commonly, sulfonyl groups and their derivatives and carboxylic acid groups and their derivatives are utilized to provide both the permionic membranes herein contemplated and the microporous diaphragms optically having cation selective groups thereon.

It has been reported that superior results are obtained in the electrolysis of alkali metal chlorides in electrolytic cells having synthetic separators if the synthetic separator is spaced from the active cathodic electrode. One way in which this may be accomplished is by mounting the synthetic separator on the anode. However, synthetic separators are normally supplied as large sheets. Mounting the sheets on an electrode to form a closed envelope requires sealing the sheets of synthetic separator material. Sealing may involve the use of heat, strongly acidic media, and strongly alkaline media. This is deleterious to the anode if any part of the sealing is done after the synthetic separator is mounted on the anode.

Therefore, it has now been found that a particularly desirable electrode configuration can be provided having the synthetic separator spaced from the cathode and characterized by a hollow cathode finger, extensions extending outwardly, and a synthetic separator around the cathode element, that is, around the cathode finger and supported by the outwardly extending extensions. The extensions may be the electrolytically active surfaces or they may extend outwardly from the electrolytically active surface.

Such a separator may be utilized in either a monopolar cell or a bipolar cell and offers the advantage of the separator being spaced from the cathode, for example, nearer the anode than the cathode.

THE FIGURES

FIG. 3 shows an isometric view, in partial cutaway, of a cathode element herein contemplated.

FIG. 4 shows a cutaway view of a bipolar element of FIG. 2 along cutting plane 4'—4'.

FIG. 5 shows a cutaway view of a bipolar element of FIG. 2 along cutting plane 5'—5'.

DETAILED DESCRIPTION OF THE INVENTION

One exemplification of the cathode element herein contemplated has a hollow cathode finger with a pair of electrolyte permeable side walls substantially parallel to and spaced from each other. The side walls have extensions bonded thereto and extending outwardly therefrom which serve to separate a synthetic separator which surrounds the cathode element from the side walls of the cathode, maintaining the synthetic separator spaced from and substantially parallel to the side walls of the cathode element. The cathode element is part of a cathode unit containing the cathode element, a backplate in electrical contact with the cathode element through electrical conduction means, and a back screen spaced from and substantially parallel to the backplate. The cathode element and the back screen have an electrolyte tight seal therebetween in order to define a volume within the cathode element and between the back screen and the backplate. This volume is the catholyte compartment.

Figure 1:
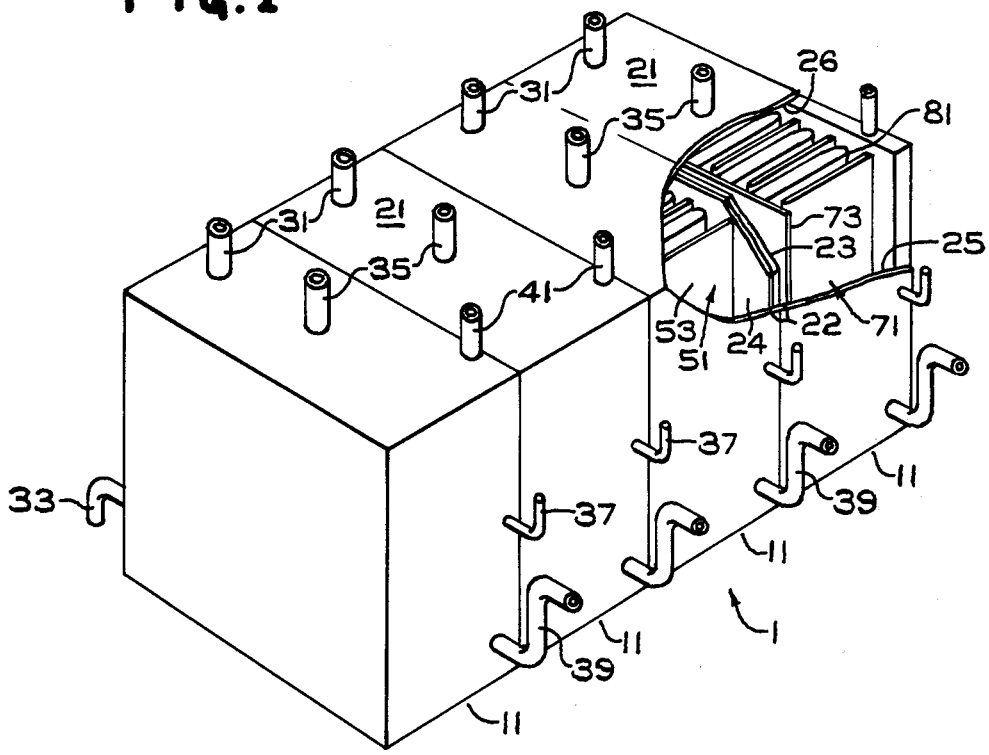
FIG. 1 shows an isometric view, in partial cutaway, of a bipolar electrolyzer.

The relationship of the cathode structure of the invention to an electrolytic cell, e.g., an electrolytic cell of a bipolar electrolyzer, is shown in FIG. 1. The bipolar electrolyzer 1 has a plurality of individual electrolytic cells 11, e.g., from 2 to 100 or more. Each individual electrolytic cell 11 has an anodic unit 51 of one bipolar unit 21 and a cathodic unit 71 of an adjacent bipolar unit 21. Each cell contains an anodic unit 51 containing brine feed means 31, brine recovery means 33, and a chlorine outlet 35. Additionally, the anodic unit 51 has an anolyte-resistant sheet 24 on the backplate 22 and an anolyte-resistant lining 28 on the interior surfaces of the unit 51 such as the cell walls 25, the top of the cell 26, and the bottom of the cell 27. Extending outwardly from the anodic unit 51 are anode blades 53.

The cathodic unit 71 of the cell 11 has water feed means 37, cell liquor recovery 39, hydrogen recovery 41, a cathode element 81, and a back screen 73 spaced from the backplate 22.

Figure 2:
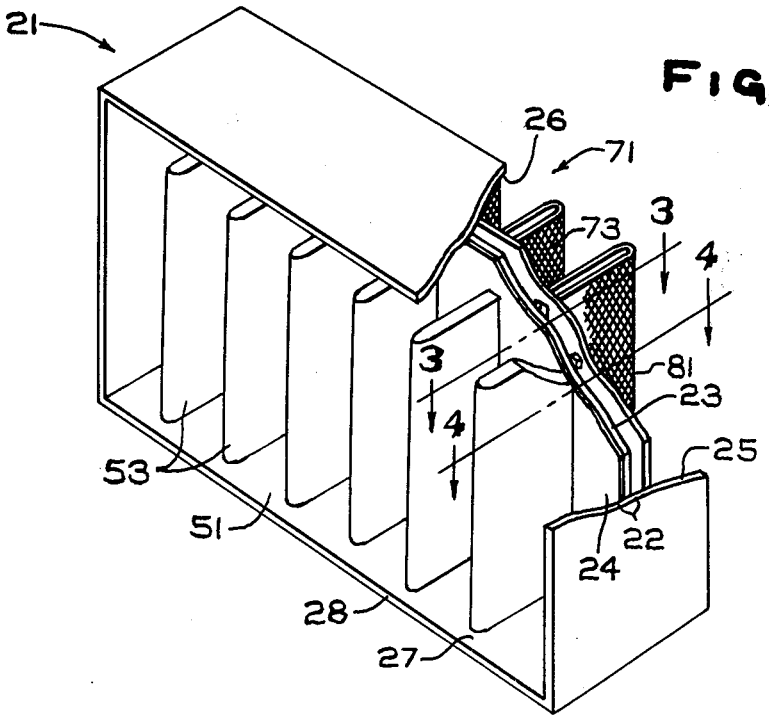
FIG. 2 shows an isometric view, in partial cutaway, of a bipolar element, that is, a bipolar electrode.

The basic structural element of the electrolyzer 1 is the bipolar unit 21 shown generally in FIG. 1 and in detail in FIGS. 2, 4, and 5. Backplate 22 separates the anodic unit 51 of the bipolar unit from the cathodic unit 71 of the bipolar unit 21. The backplate 22 has two members, a heavy catholyte-resistant plate 23 and a thin anolyte-resistant sheet 24. As described above, a thin anolyte-resistant sheathing, layer, lining, or sheeting 28 lines the top 26, bottom 27, and walls 28 of the bipolar unit 21 within the anolyte compartment.

Anodes 53 extend outwardly from the backplate 22 while cathode elements 81 extend outwardly from the opposite side 23 of the bipolar unit 21.

The cathode unit 71 of the bipolar unit 21 includes a plurality of individual cathode elements 81 having cathode fingers 83 and a synthetic separator 101 spaced from the cathode fingers 83 by extensions 91. The cathode unit 71 also includes a back screen 73 spaced from the backplate 22 and substantially parallel to the backplate 22. The back screen 73 can be fabricated of the same material as the cathodic electrodes 83, and it may or may not have extensions 91. When the back screen 73 is made of the same material as the cathodic electrodes 83, it can serve as an auxiliary electrode area. It can, however, be fabricated of a nonactive but permeable metal to allow the synthetic separator 101 to function. The back screen 73 may also be fabricated of material that is substantially impermeable to the flow of either electrolyte or ion.

The electrolyte impermeable side walls 85 of the individual cathode element 81 are parallel to each other and spaced from each other. They may be fabricated of materials of construction conventionally used to fabricate cathodes such as iron, alloys of iron with cobalt, nickel, manganese, carbon, and the like. Alternatively, the electrolyte permeable side walls 85 may be fabricated of stainless steel.

The side walls 85 of the hollow cathode fingers 83 may be electrolyte permeable as perforate or foraminous mesh, plate, or sheet. Alternatively, they may be louvered whereby to allow electrolyte to pass through. The cathode element 81 can either be open or closed at the top as appropriate to allow for bonding, joining, and sealing of the synthetic separator 101, for example, by masked compressive means or the like.

Extensions 91 are joined to the side walls 85 of the cathode fingers 83. The purpose of the extensions 91 is to space the synthetic separator 101 from the cathode side walls 85 and, in one exemplification, shown in FIG. 6, to provide added electrolytic surface area as where the extensions 91 are electrolytically active.

The extensions 91 may either be conductive or nonconductive. When conductive they may be fabricated of a metallic material, for example, the same material as the cathode finger, i.e., iron, various iron alloys, steel, or stainless steel as described hereinabove. When nonconductive they may be fabricated of a film-forming metal such as titanium, tantalum, or tungsten. Alternatively, the extensions 91 may be ceramic, carbonaceous, graphitic, or polymeric.

The extensions 91 may be joined to the cathode side walls 85 by welding, bolting, soldering, forming, stamping, or cementing. The extensions 91 may be hollow to allow air or oxidizing gas to pass therethrough, for example, to depolarize the cathode.

The extensions 91 may be vertical or horizontal or inclined at an angle. Vertical extensions 91 are preferred when the extensions 91 are parallel to the side walls 85. While the extensions 91 may be parallel to the side walls 85, they may also be substantially perpendicular to the side walls 85. They may be in the form of rods, bars, or fins and extend to about 10 millimeters from the surface of the cathode if nonconductive and to about 15 or 20 millimeter if conductive and are from about 2 to about 10 millimeters apart.

Figure 6:
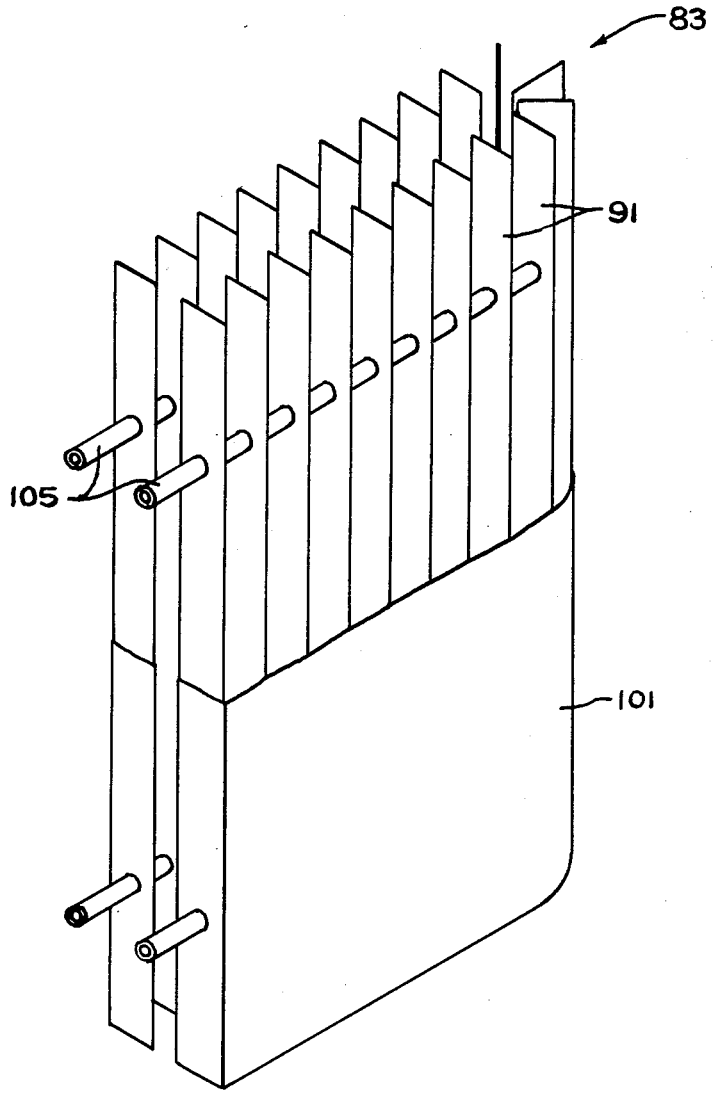
FIG. 6 shows an isometric view, in partial cutaway, of an alternative exemplification of the cathode element.

In the exemplification shown in FIG. 6, the side walls 85 are dispensed with, the extensions 91 being the electrolytically active cathodic surfaces. As there shown, the cathode element 81 has a cathode finger 83 with a cathodic conductor 105. The cathodic conductor 105 is substantially perpendicular, along its major axis, to the backplate 22 and to the back screen 73. The individual cathodic electrodes are the extensions 91. The cathode electrodes 91 are blade-like and substantially perpendicular to the principal or main axis of the cathodic conductor 105. The permionic membrane 101 rests upon the blade-like electrodes 91.

The synthetic separator 101 is on the exterior surface of the cathode finger 83. The plane formed by the edges and tips of the extensions 91 supports the synthetic separator 101. The synthetic separator 101 may also be on the outer surface of the back screen 73.

There may be one sheet 101 of synthetic separator over all the fingers 81 and back screen 73 or separate sheets 101, for example, as shown in FIG. 3, to allow for individual removal and adjustment of the individual cathode fingers 83.

The cathode unit herein contemplated may either be part of a bipolar electrolyzer or may be part of a monopolar cell.

While the invention is described with respect to certain exemplifications and embodiments thereof, the invention is not to be limited except as in the claims appended hereto.

I claim:

1. A cathode element comprising:

a hollow cathode finger having a pair of electrolyte permeable side walls substantially parallel to and spaced from each other;

said side walls having extensions bonded thereto and extending outwardly therefrom; and a synthetic separator surrounding said cathode element, spaced from and substantially parallel to the side walls thereof, and resting upon the extensions.

2. The cathode element of claim 1 wherein the extensions are fins.

3. The cathode element of claim 1 wherein the extensions are rods substantially parallel to each other and to the side walls.

4. The cathode element of claim 1 wherein the extensions are rods substantially parallel to each other and substantially perpendicular to the side walls.

5. The cathode element of claim 1 wherein the extensions are substantially nonconductive.

6. The cathode element of claim 1 wherein the side walls are perforate.

7. The cathode element of claim 1 wherein the side walls are mesh.

8. A cathode unit comprising:

(a) a cathode element containing:

(1) a hollow cathode finger having a pair of electrolyte permeable side walls substantially parallel to and spaced from each other and electrical conduction means at a base thereof;

(2) said side walls having extensions bonded thereto and extending outwardly therefrom;

(3) a synthetic separator surrounding said cathode element, substantially parallel to and spaced from the side walls thereof, and resting upon the extensions;

(b) a backplate in electrical contact with the cathode element through said electrical conduction means; and (c) a back screen spaced from and substantially parallel to said backplate, said cathode finger and said back screen having an electrolyte tight seal therebetween whereby to define a volume within said hollow finger and between said back screen and said backplate.

9. The cathode unit of claim 8 wherein the extensions are fins.

10. The cathode unit of claim 8 wherein the extensions are rods substantially parallel to each other and to the side walls.

11. The cathode unit of claim 8 wherein the extensions are rods substantially parallel to each other and substantially perpendicular to the side walls.

12. The cathode unit of claim 8 wherein the extensions are substantially nonconductive.

13. The cathode unit of claim 8 wherein the side walls are perforate.

14. The cathode unit of claim 8 wherein the side walls are mesh.

15. A cathode unit comprising:

(a) a cathode element containing:

(1) a cathode finger having a cathode conductor with electrical connection means at a base thereof;

(2) cathode blades mounted on said cathode conductor and substantially perpendicular to the main axis thereof;

(3) a synthetic separator surrounding said cathode element and resting upon the cathode blades;

(b) a backplate in electrical contact with the cathode element through electrical conductive means; and (c) a back screen spaced from and substantially parallel to said backplate and substantially perpendicular to said cathode finger, said cathode finger and said back screen having an electrolyte tight seal therebetween whereby to define a volume within said finger and between said back screen and said backplate.

16. The cathode unit of claim 15 wherein the cathode blades are substantially parallel to each other.

* * * * *